US005657724A

United States Patent [19]

Brown et al.

[11] Patent Number: 5,657,724

[45] Date of Patent: Aug. 19, 1997

[54] INTERNAL COMBUSTION ENGINE CONSTRUCTION

[75] Inventors: Peter W. Brown, Lake Villa; George L. Broughton, Zion, both of Ill.

[73] Assignee: Outboard Marine Corporation, Waukegan, Ill.

[21] Appl. No.: 552,395

[22] Filed: Nov. 3, 1995

[51] Int. Cl.[6] ..... F01L 7/12

[52] U.S. Cl. ..... 123/73 R; 123/317; 123/195 R

[58] Field of Search ..... 123/73 R, 73 A, 123/73 B, 73 C, 317, 318, 195 R

[56] References Cited

U.S. PATENT DOCUMENTS

| | | | |
|---|---|---|---|
| 2,067,715 | 1/1937 | Kylén | 123/317 |
| 2,433,111 | 12/1947 | Gehres | 123/69 R |
| 3,179,093 | 4/1965 | Sims et al. | 123/73 R |
| 3,182,642 | 5/1965 | Drtina | 123/73 R |
| 3,499,425 | 3/1970 | Gommel | 123/318 |
| 3,613,646 | 10/1971 | Hisada | 123/317 |
| 3,926,157 | 12/1975 | Lippitsch | 123/73 R |
| 3,973,532 | 8/1976 | Litz | 123/317 |
| 4,104,994 | 8/1978 | Phillips | 123/73 R |
| 4,126,106 | 11/1978 | Witzky | 123/262 |
| 4,202,298 | 5/1980 | Boyesen | 123/73 A |
| 4,287,860 | 9/1981 | Fujikawa et al. | 123/73 A |
| 4,362,132 | 12/1982 | Neuman | 123/73 R |
| 4,395,978 | 8/1983 | Boyesen | 123/73 PP |
| 4,461,251 | 7/1984 | Scheaffer | 123/317 |
| 4,474,145 | 10/1984 | Boyesen | 123/73 R |
| 4,475,499 | 10/1984 | Scheaffer | 123/317 |
| 4,538,567 | 9/1985 | Grow | 123/305 |
| 4,545,346 | 10/1985 | Grow | 123/305 |
| 4,660,513 | 4/1987 | Figliuzzi | 123/65 A |
| 4,879,974 | 11/1989 | Alvers | 123/51 A |
| 4,907,544 | 3/1990 | Burrahm | 123/26 |
| 5,005,539 | 4/1991 | Kawamura | 123/21 |
| 5,007,382 | 4/1991 | Kawamura | 123/21 |
| 5,022,353 | 6/1991 | Kawamura | 123/21 |
| 5,036,801 | 8/1991 | Imajou | 123/21 |
| 5,230,314 | 7/1993 | Kawahara et al. | 123/317 |
| 5,279,269 | 1/1994 | Aizawa et al. | 123/317 |
| 5,360,079 | 11/1994 | Ichikawa et al. | 123/73 R |

FOREIGN PATENT DOCUMENTS

| | | | |
|---|---|---|---|
| 1576763 | 3/1970 | Germany | 123/73 R |
| 3129609 | 7/1981 | Germany . | |
| 0757757 | 1/1994 | U.S.S.R. . | |
| 2005766 | 4/1979 | United Kingdom | 123/73 R |

*Primary Examiner*—David A. Okonsky
*Attorney, Agent, or Firm*—Jones, Day, Reavis & Pogue

[57] ABSTRACT

Disclosed herein is an internal combustion engine comprising a crankcase assembly including a crankcase member including a crankcase cover mounting surface, and a cylinder assembly mounting surface including therein an opening, and a cylinder block fabricately separately from the crankcase assembly and including a crankcase member surface fixed to the cylinder assembly mounting surface, and a cylinder extending from the crankcase member mounting surface and communicating with the opening in the cylinder assembly mounting surface.

20 Claims, 4 Drawing Sheets

INTERNAL COMBUSTION ENGINE CONSTRUCTION

BACKGROUND OF THE INVENTION

The invention relates generally to internal combustion engines and to both two-stroke and four-stroke engines. In the past, the crankcases of two-stroke and four-stroke engines were generally differently constructed. One difference was, in two-stroke engine construction, the employment of separate, sealed crankcase chambers for each cylinder, whereas, in four-stroke engine construction, such separate sealed crankcase chambers were generally not employed. Another difference was that, in two-stroke engine construction, mist lubricated needle bearings were generally employed to support the crankshaft, whereas, in four-stroke engine construction, pressure lubricated journal bearings were commonly employed.

Attention is directed to the following U.S. Pat. Nos.:

| | |
|---|---|
| 2,067,715 | Issued January 12, 1937 |
| 2,433,111 | Issued December 23, 1947 |
| 3,499,425 | Issued March 10, 1970 |
| 3,613,646 | Issued October 19, 1971 |
| 3,973,532 | Issued August 10, 1976 |
| 4,126,106 | Issued November 21, 1978 |
| 4,461,251 | Issued July 24, 1984 |
| 4,475,499 | Issued October 9, 1984 |
| 4,538,567 | Issued September 3, 1985 |
| 4,545,346 | Issued October 8, 1985 |
| 4,660,513 | Issued April 28, 1987 |
| 4,879,974 | Issued November 14, 1989 |
| 4,907,544 | Issued March 13, 1990 |
| 5,005,539 | Issued April 9, 1991 |
| 5,007,382 | Issued April 16, 1991 |
| 5,022,353 | Issued June 11, 1991 |
| 5,036,801 | Issued August 6, 1991 |
| 5,230,314 | Issued July 27, 1993 |
| 5,279,269 | Issued January 18, 1994 |

Attention is directed to the following foreign patents:

| | |
|---|---|
| DE 3129-609 | Dated July 28, 1981 |
| SU 0757-747 | Dated August 25, 1980 |

SUMMARY OF THE INVENTION

The invention provides an internal combustion engine comprising a crankcase assembly including a crankcase member including a crankcase cover mounting surface, and a cylinder assembly mounting surface including therein an opening, and a cylinder block fabricated separately from the crankcase assembly and including a crankcase member surface fixed to the cylinder assembly mounting surface, and a cylinder extending from the crankcase member mounting surface and communicating with the opening in the cylinder assembly mounting surface.

The invention also provides an internal combustion engine comprising a crankcase assembly including a crankcase member including a crankcase cover mounting surface, and a cylinder assembly mounting surface including therein an opening, a crankcase cover fixed to the crankcase member to define therebetween a crankcase communicating with the opening in the cylinder mounting surface, needle roller bearings supported by the crankcase, a crankshaft supported by the roller bearings, extending in the crankcase, and including a crankpin, and a connecting rod rotatably mounted on the crankpin and extending through the opening in the cylinder assembly mounting surface, a cylinder assembly fabricated separately from the crankcase assembly and including a crankcase member surface fixed to the cylinder assembly mounting surface of the crankcase assembly, a cylinder extending from the crankcase member mounting surface and communicating with the opening in the cylinder assembly mounting surface of the crankcase assembly, and a piston located in and being axially moveable in the cylinder, and connected to the connecting rod.

The invention also provides a two-stroke internal combustion engine comprising a crankcase assembly including a crankcase member including a crankcase cover mounting surface, and a cylinder assembly mounting surface including therein an opening, an inlet port, and a discharge port, an inlet passage communicating with the inlet port, a discharge passage communicating with the discharge port, a crankcase cover fixed to the crankcase member to define therebetween a crankcase communicating with the opening in the cylinder mounting surface and with the inlet passage and the discharge passage in the crankcase member, needle roller bearings supported by the crankcase, a crankshaft supported by the roller bearings, extending in the crankcase, and including a crankpin, and a connecting rod rotatably mounted on the crankpin and extending through the opening in the cylinder assembly mounting surface, a cylinder assembly including a crankcase mounting surface fixed to the cylinder assembly mounting surface of the crankcase assembly, a cylinder extending from the crankcase assembly mounting surface, communicating with the opening in the cylinder assembly mounting surface of the crankcase assembly, and including a cylindrical wall, a piston located in and being axially moveable in the cylinder, and connected to the connecting rod.

The invention also provides a four-stroke internal combustion engine comprising a crankcase assembly including a crankcase member including a crankcase cover mounting surface, and a cylinder assembly mounting surface including therein an opening, an inlet port, and a discharge port, an inlet passage communicating with the inlet port, a discharge passage communicating with the discharge port,a crankcase cover fixed to the crankcase member to define therebetween a crankcase communicating with opening in the cylinder mounting surface, needle roller bearings supported by the crankcase, a crankshaft supported by the roller bearings, extending in the crankcase, and including a crankpin, and a connecting rod rotatably mounted on the crankpin and extending through the opening in the cylinder assembly mounting surface, a cylinder assembly including a crankcase mounting surface fixed to the cylinder assembly mounting surface of the crankcase assembly, a cylinder extending from the crankcase assembly mounting surface and communicating with the opening in the cylinder assembly mounting surface of the crankcase assembly, and a cylinder head mounting surface extending from the cylinder in axially spaced and parallel relation from the crankcase assembly mounting surface, and a cylinder head fixed to the cylinder head mounting surface and including an exhaust port, and an inlet port, and a piston located in and being axially moveable in the cylinder, and connected to the connecting rod.

Other features and advantages of the invention will become apparent to those skilled in the art upon review of the following detailed description, claims and drawings.

DESCRIPTION OF THE DRAWINGS

FIG. 2 is a sectional view taken along line 2—2 of FIG. 1.

Figure 1:
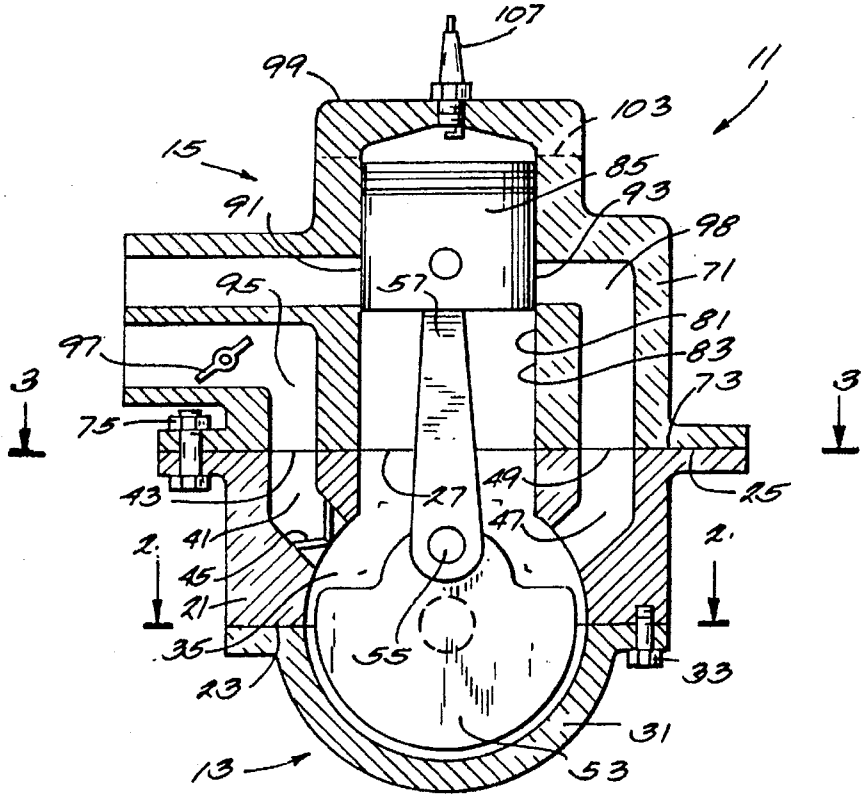
FIG. 1 is a diagrammatic view of a first embodiment of a two-stroke internal combustion engine embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown diagrammatically in FIG. 1 is a two-stroke internal combustion engine 11 including a crankcase assembly 13 and a cylinder assembly 15.

The crankcase assembly 13 comprises a crankcase member 21 including a crankcase cover mounting surface 23, and a cylinder assembly mounting surface 25 including therein an opening 27. The crankcase assembly 13 also includes a crankcase cover 31 fixed to the crankcase member 21 by any suitable means, such as a series of bolts 33 (one shown), to define therebetween a crankcase 35 communicating with the opening 27 in the cylinder mounting surface 25.

The crankcase member 21 also includes a combustion air or fuel/air mixture inlet passage 41 which communicates between the crankcase 35 and an inlet port 43 in the cylinder assembly mounting surface 25. Preferably, the combustion air or fuel/air inlet passage 41 includes valve means affording inflow into the crankcase 35 and preventing outflow from the crankcase 35. While other constructions can be employed, in the disclosed construction, such valve means comprises a suitable reed valve 45. In addition, the crankcase member 21 also preferably includes a combustion air or fuel/air mixture discharge passage 47 which communicates between the crankcase 35 and a discharge port 49 located in the cylinder assembly mounting surface 25.

The crankcase assembly 13 also includes (see FIG. 2) a plurality of needle roller bearings 51 which are supported by the crankcase member 21 and the crankcase cover 31 and which, in turn, rotatably support a crankshaft 53 which extends in the crankcase 35 and which includes a crankpin 55. Rotatively connected to the crankpin 55 is a connecting rod 57 which extends through the opening 27 in the cylinder assembly mounting surface 25.

The cylinder assembly 15 comprises a cylinder block 71 including a crankcase member or crankcase assembly mounting surface 73 suitably fixed to the cylinder assembly mounting surface 25 of the crankcase assembly 13, as by a plurality of suitable bolts 75 (one shown). The cylinder assembly 15 also includes a cylinder 81 extending from the crankcase member mounting surface 73, communicating with the opening 27 in the cylinder assembly mounting surface 25 of the crankcase assembly 13, and including a cylindrical wall 83. In addition, the cylinder assembly 15 includes a piston 85 located in and being axially moveable in the cylinder 81, and rotatively connected to the connecting rod 57.

The cylindrical wall 83 of the cylinder 81 includes therein, as is customary in two-stroke engines, an exhaust port 91 which is opened and closed in response to piston movement, and a combustion air or fuel/air mixture inlet port 93 which is also opened and closed in response to piston movement.

The cylinder assembly 15 also includes a combustion air or fuel/air mixture inlet passage 95 which extends from the crankcase assembly mounting surface 73 and which communicates with the inlet port 43 in the cylinder assembly mounting surface 25. If desired, the reed valve 45 in the combustion air or fuel/air mixture inlet passage 41 can be omitted, and instead, valve means (not shown) permitting flow into the crankcase 35 and preventing flow from said crankcase 35 can be included in the inlet passage 95. While any suitable such valve means can be employed, in the disclosed construction, a suitable reed valve can be employed.

Any suitable means can be employed for feeding fuel to the engine 11. Thus, inlet passage 95 can include a carburetor (not shown) operative to feed fuel to the engine 11. Alternatively, a fuel injector (not shown) can be employed and the inlet passage 95 can merely include a throttle valve 97 controlling combustion air inflow. The cylinder assembly 15 also includes a transfer passage 98 which communicates with the discharge port 49 in the cylinder assembly mounting surface 25 and with the inlet port 93 in the cylindrical wall 83.

The cylinder block 71 can be fabricated, as shown in FIG. 1, in one-piece, including the crankcase member mounting surface 73, the cylinder 81, and a cylinder head 99 located in axially spaced relation to the crankcase member mounting surface 73.

Alternatively, the cylinder block 71 can be fabricated in one-piece, including the crankcase member mounting surface 73, the cylinder 81, and a cylinder head mounting surface 103 (shown in dotted outline) extending from the cylindrical wall 83 and located in axially spaced relation to the crankcase member mounting surface 73. In this instance, the cylinder assembly 15 also includes the cylinder head 99 which is separately fabricated and which is fixed to the cylinder head mounting surface 103 by a plurality of bolts (not shown) or by other suitable means.

Any suitable spark plug 107 can be employed.

Any suitable means can be employed to supply the engine 11 with lubricating oil. For instance, lubricating oil can be mixed with the fuel, particularly if a carburetor (not shown) is employed.

Figure 4:
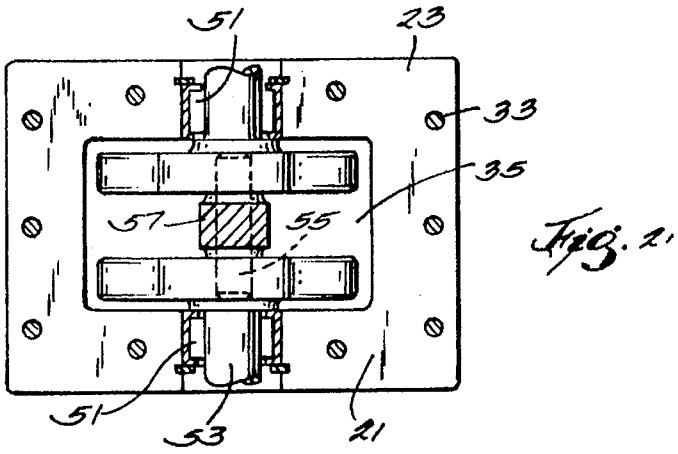
FIG. 4 is a diagrammatic view of a second embodiment of a two-stroke internal combustion engine embodying various of the features of the invention.

Shown diagrammatically in FIG. 4 is a second embodiment of a two-stroke internal combustion engine 107 which is similar to the engine 11 shown in FIG. 1, except that the inlet and discharges passages 41 and 47, respectively, provided in the crankcase member 21 of the engine 11 are omitted, except that there the opening or hole 27 is the only opening or hole (except for bolt holes) in the cylinder assembly mounting surface 25, except that the inlet passage 95 and the transfer passage 98 formed in the cylinder block 71 communicate with the cylinder 81 adjacent the crankcase member mounting surface 73, and except for omission of the reed valve 45 located in the inlet passage 41 of the crankcase member 21 of the engine 11, and location of the reed valve 45 in the inlet passage 95 in the cylinder block 71. In other respects, the construction of the engine 107 is identical to the construction of the engine 11 and, accordingly, the same reference numerals as applied in FIG. 1 have also been applied in FIG. 4 to the comparable components.

Figure 5:
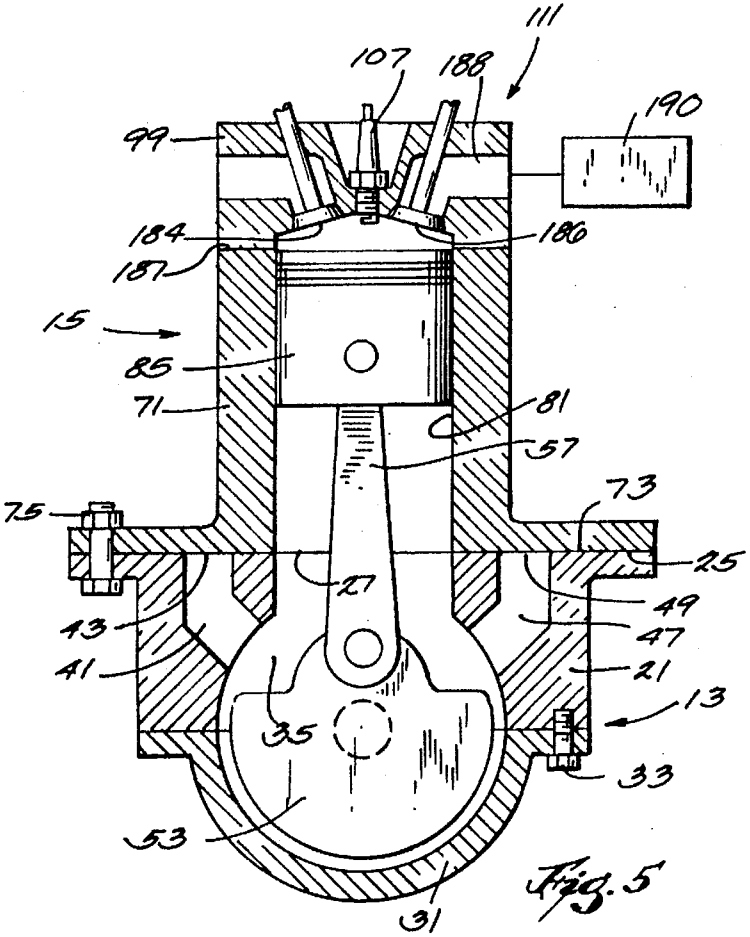
FIG. 5 is a diagrammatic view of a first embodiment of a four-stroke internal combustion engine embodying various of the features of the invention.

Shown diagrammatically in FIG. 5 is a first embodiment of a four-stroke internal combustion engine 111 including a crankcase assembly 13 and a cylinder assembly 15.

The crankcase assembly 13 is constructed identically to the crankcase assembly 13 described with respect to the two-stroke engine 11 shown in FIG. 1 and thus will not be further described, except to state that, in the drawings, the same reference numerals applied in FIG. 1 have also been applied to the same components in FIG. 2, and except that the reed valve 45 is omitted.

The cylinder assembly 15 of the four-stroke engine 111 includes a cylinder block 71 comprising a crankcase member mounting surface 73 fixed to the cylinder assembly mounting surface 25 of the crankcase assembly 13 by any suitable means, such as by a plurality the bolts 75. The cylinder assembly 15 also includes a cylinder 81 which extends from the crankcase member mounting surface 73, and which communicates with the opening 27 in the cylinder member mounting surface 73 of the crankcase assembly 13, and a cylinder head mounting surface 187 which extends from the cylinder 81 in axially spaced and parallel relation to the crankcase member mounting surface 73.

In addition, the cylinder assembly 15 also includes a cylinder head 99 which is fixed to the cylinder head mounting surface 187 by any suitable means, such as by a plurality of bolts (not shown), and which conventionally includes an exhaust port 184, and a combustion air or fuel/air mixture inlet port 186 which can communicate through an inlet passage 188 with a carburetor 190. Alternatively, combustion air alone can be introduced through the inlet port 186 and fuel can be injected directly into the cylinder 181, or into the inlet passage 188, or elsewhere, by a fuel injector (not shown). In the cylinder assembly 15, the crankcase member mounting surface 73 serves to close the inlet port 43 and the discharge port 49 which communicate with the crankcase 35. If desired, in the engine 111, the inlet passage 41 and the discharge passage 47 can be omitted from the crankcase assembly 113.

Still further in addition, the cylinder assembly 15 includes a piston 85 located in and being axially moveable in the cylinder 81, and rotatively connected to the connecting rod 57.

As with respect to the two-stroke engine 11 shown in FIG. 1, any suitable spark plug 107 can be employed and any suitable means can be employed to lubricate the various components of the engine 111.

Figure 6:
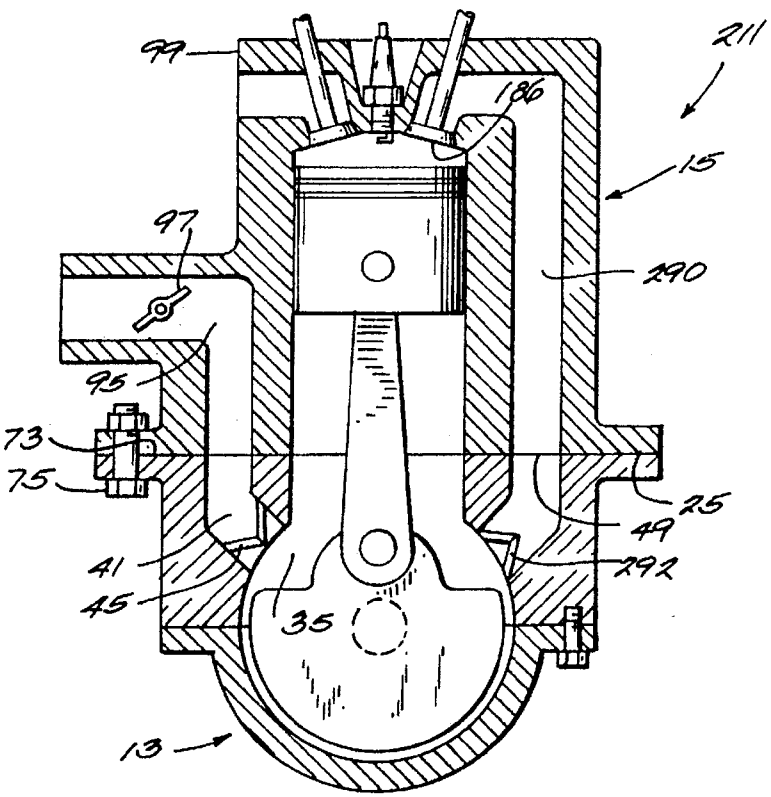
FIG. 6 is a diagrammatic view of a second embodiment of a four-stroke internal combustion engine embodying various of the features of the invention.

Shown diagrammatically in FIG. 6 is a second embodiment of a supercharged four-stroke engine 211 which includes a crankcase assembly 13 and a cylinder assembly 15, and which is generally constructed in the same manner as explained with respect to the engine 111 shown in FIG. 5, except as will be explained hereinafter. Accordingly, some of the same reference numerals applied in FIG. 5 have also been applied to the same components in FIG. 6.

The engine 211 is supercharged by fabricating the cylinder assembly 15 to include an air inlet passage 95 which is constructed in a generally identically manner to the inlet passage 95 described with respect to the two-stroke engine 11 shown in FIG. 1, and which extends from the crankcase member mounting surface 73 and communicates with the inlet port 43 in the cylinder assembly mounting surface 25. As in the construction shown in FIG. 1, the inlet passage 95 can communicate with a carburetor (not shown) when an fuel/air mixture is supplied to the crankcase 35, or can include a throttle valve 97 when only combustion air is supplied to the crankcase 35. In addition, as also provided in the engine 11 shown in FIG. 1, the inlet passage 41 includes suitable valve means permitting flow into the crankcase 35 and preventing flow from the crankcase 35. While other constructions can be employed, in the disclosed construction, the valve means comprises the reed valve 45. Alternatively, any suitable similar valve, such as a reed valve, can be included in the inlet passage 95 included in the cylinder assembly 13.

In addition, in order to provide supercharging, the engine 211 further includes a conduit or passage 290 which communicates between the discharge port 49 in the cylinder assembly mounting surface 25 and the inlet port 186 in the cylinder head 99. Still further in addition, the engine 211 includes valve means permitting flow from the crankcase 35 to the conduit 290 and preventing flow from the conduit 290 to the crankcase 35. While other constructions can be employed, in the disclosed construction, the valve means comprises a reed valve 292 located in the discharge passage 47 in the crankcase member 21. Alternatively the reed valve 292 can be located in the conduit or passage 290 in the cylinder assembly 13.

Figure 7:
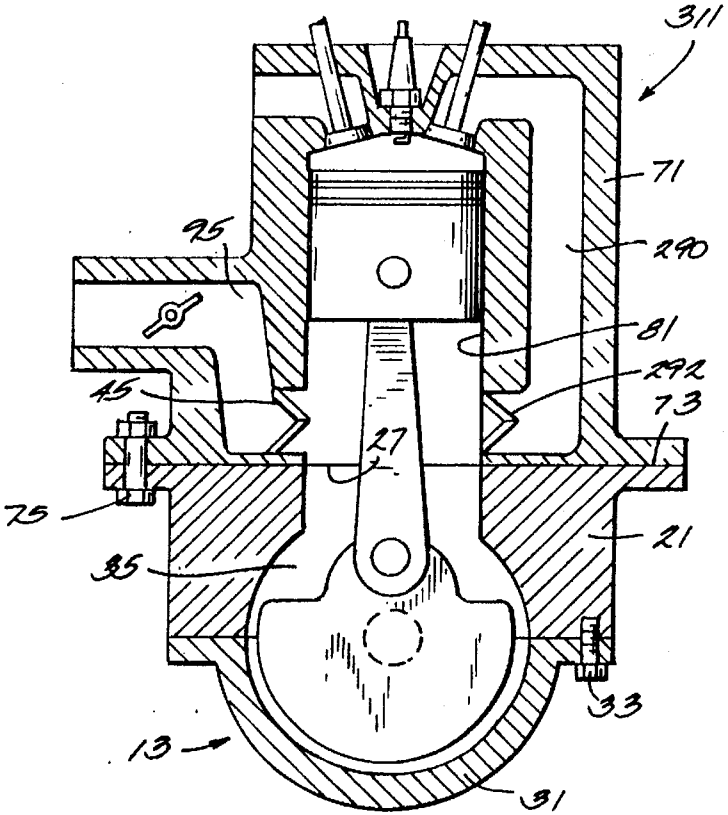
FIG. 7 is a diagrammatic view of a third embodiment of a four-stroke internal combustion engine embodying various of the features of the invention.

Shown diagrammatically in FIG. 7 is a third embodiment of a supercharged four-stroke engine 311 which is generally constructed in the same manner as explained with respect to the engine 211 shown in FIG. 6, except as will be explained hereinafter. Accordingly, some of the same reference numerals applied in FIGS. 5 and 6 have also been applied to the same components in FIG. 7.

The four-stroke engine 311 differs from the four-stroke engine 211 in that the crankcase member 21 is identical to that employed in the two-stroke engine 107, i.e., in that the crankcase member 21 omits the inlet passage 41 and the discharge passage 47. Instead, the inlet passage 95 and the conduit or passage 290 of the cylinder block 71 communicate with the cylinder 81 adjacent the crankcase member mounting surface 73, and except that the reed valves 45 and 292 are respectively relocated to the inlet passage 95 and the conduit or passage 290 in the cylinder block 71 and are placed adjacent the crankcase member 21.

Figure 8:
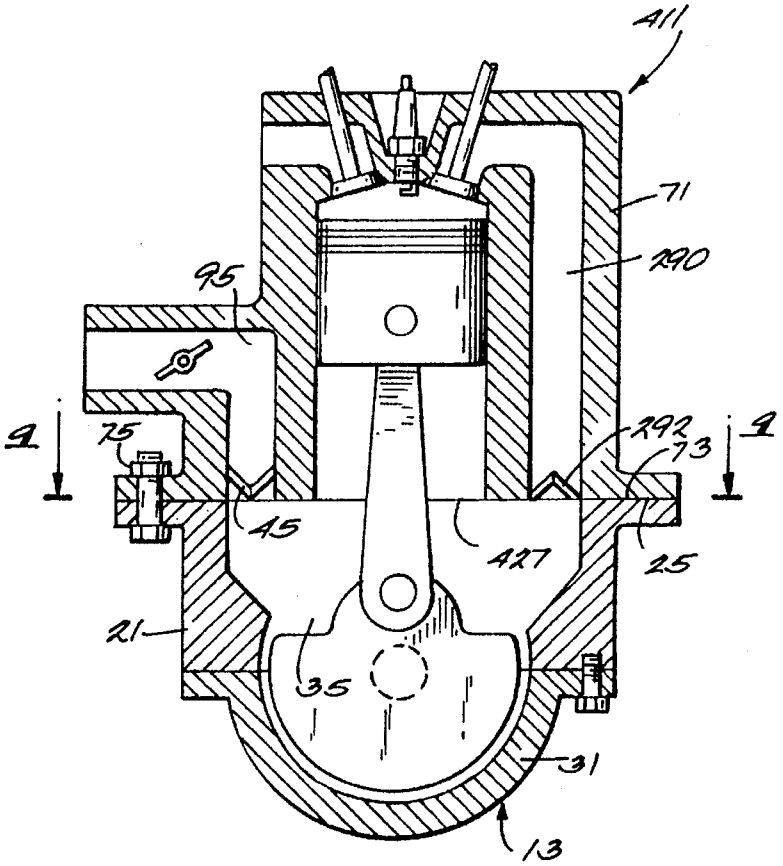
FIG. 8 is a diagrammatic view of a fourth embodiment of a four-stroke internal combustion engine embodying various of the features of the invention.
Figure 4:
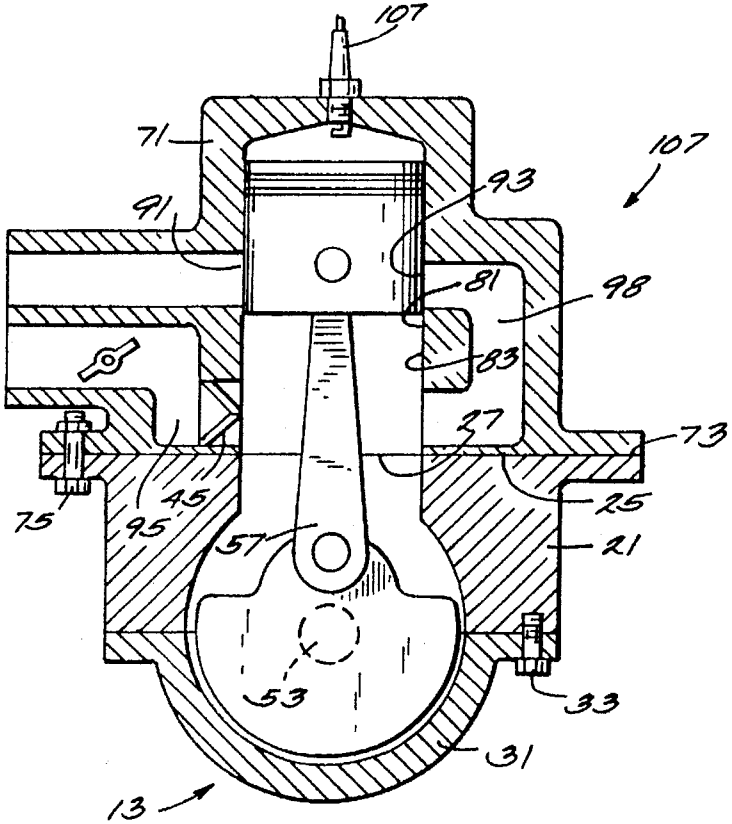

Shown diagrammatically in FIG. 8 is a fourth embodiment of a supercharged four-stroke engine 411 which is generally constructed in the same manner as explained with respect to the engine 211 of FIG. 6, except as will be explained hereinafter. Accordingly, some of the same reference numerals applied in FIGS. 5 and 6 have also been applied to the same components in FIG. 8.

The four-stroke engine 411 shown in FIG. 8 differs from the engine 211 shown in FIG. 6 in that the inlet passage 41 and the discharge passage 47 in the crankcase member 21 of the engine 211 have been omitted, and except that the opening 27 has been combined with the inlet port 43 and the discharge port 49 in a single enlarged opening 427 providing communication of the cylinder 81, the inlet passage 95, and the conduit or passage 290 with the crankcase 35. In addition, in the engine 411, the reed valves 45 and 292 have been respectively relocated to the inlet passage 41 and conduit or passage 290 in the cylinder block 71 and placed adjacent the crankcase mounting surface 73.

Figure 9:
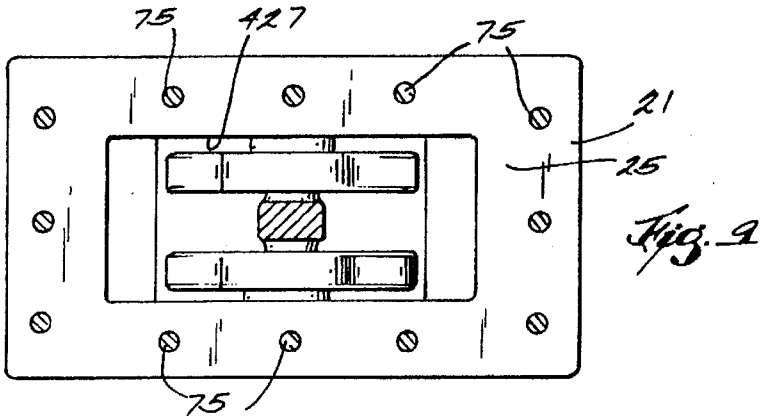
FIG. 9 is a sectional view taken along line 9—9 of FIG. 8.
Figure 3:
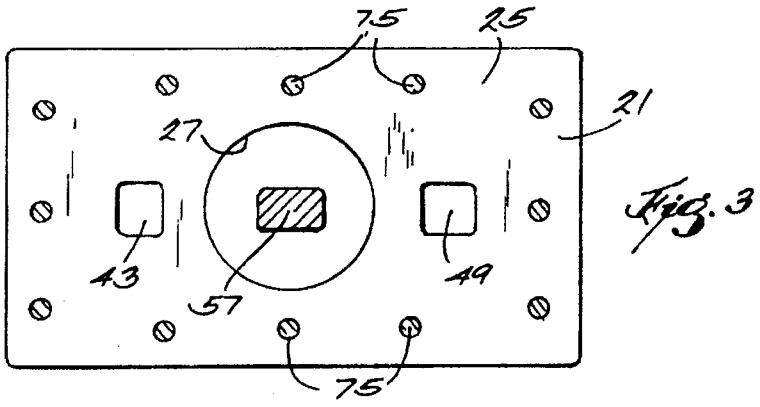
FIG. 3 is a sectional view taken along line 3—3 of FIG. 1.

The combined opening 427 shown in FIGS. 8 and 9 can also be employed in the two-stroke engine 11 shown in FIG. 1 (with relocation of the reed valve 45 to the inlet passage 95 in the cylinder block 71).

Alternatively, in another construction (not shown),the conduit or passage 290 can be formed separately from the cylinder assembly 15 and suitably connected to a discharge port (not shown) in the crankcase assembly 13 and to the passage 188 in the cylinder head 99.

As with respect to the two-stroke engines 11 and 107 shown in FIGS. 1 and 4, the four-stroke engines 111, 211, 311, and 411 shown in FIGS. 5, 6, 7, and 8, can employ any suitable means to lubricate the various components of the engines 111, 211, 311, and 411.

While the two- and four-stroke engines have been disclosed as single cylinder engines, the invention is equally applicable to multi-cylinder engines.

As is apparent from the foregoing, the disclosed engines include common crankcase assemblies, thus permitting manufacture of both two-stroke and four-stroke engines from common crankcase components, and thus enabling substantial savings in manufacture.

Various of the features of the invention are set forth in the following claims.

We claim:

1. An internal combustion engine comprising a crankcase assembly including a crankcase member including a crankcase cover mounting surface, and a cylinder assembly mounting surface including therein an opening, and a cylinder block fabricated separately from said crankcase assembly and including a crankcase member surface fixed to said cylinder assembly mounting surface, a cylinder extending from said crankcase member mounting surface and communicating with said opening in said cylinder assembly mounting surface, said crankcase assembly including an inlet port located in said cylinder assembly mounting surface, an inlet passage communicating between said inlet port and said crankcase, a discharge port located in said cylinder assembly mounting surface, and a discharge inlet passage communicating between said discharge port and said crankcase, said cylinder block including an inlet passage extending from said crankcase assembly mounting surface, communicating with said inlet port in said cylinder assembly mounting surface, and including a valve permitting flow into said crankcase and preventing flow from said crankcase.

2. An internal combustion engine in accordance with claim 1 wherein said crankcase assembly also includes a crankcase cover fixed to said crankcase member to define therebetween a crankcase communicating with said opening in said cylinder mounting surface.

3. An internal combustion engine in accordance with claim 1 wherein said crankcase assembly also includes needle roller bearings supported by said crankcase, a crankshaft supported by said roller bearings, extending in said crankcase, and including a crankpin, and a connecting rod rotatably mounted on said crankpin and extending through said opening in said cylinder assembly mounting surface, and wherein said cylinder assembly also includes a piston located in and being axially moveable in said cylinder, and connected to said connecting rod.

4. An internal combustion engine comprising a crankcase assembly including a crankcase member including a crankcase cover mounting surface, and a cylinder assembly mounting surface including therein an opening, a crankcase cover fixed to said crankcase member to define therebetween a crankcase communicating with said opening in said cylinder mounting surface, needle roller bearings supported by said crankcase, a crankshaft supported by said roller bearings, extending in said crankcase, and including a crankpin, and a connecting rod rotatably mounted on said crankpin and extending through said opening in said cylinder assembly mounting surface, a cylinder assembly fabricated separately from said crankcase assembly and including a crankcase member surface fixed to said cylinder assembly mounting surface of said crankcase assembly, a cylinder extending from said crankcase member mounting surface and communicating with said opening in said cylinder assembly mounting surface of said crankcase assembly, a piston located in and being axially moveable in said cylinder, and connected to said connecting rod, said crankcase assembly including an inlet port located in said cylinder assembly mounting surface, an inlet passage communicating between said inlet port and said crankcase, a discharge port located in said cylinder assembly mounting surface, and a discharge inlet passage communicating between said discharge port and said crankcase, and said cylinder assembly including an inlet passage extending from said crankcase assembly mounting surface, communicating with said inlet port in said cylinder assembly mounting surface, and including a valve permitting flow into said crankcase and preventing flow from said crankcase.

5. An internal combustion engine in accordance with claim 4 wherein said cylinder includes a cylindrical wall, and wherein said cylinder assembly also includes an exhaust port located in said cylindrical wall and opened and closed in response to piston movement in said cylinder, and a combustion air inlet port located in said cylindrical wall and opened and closed in response to piston movement in said cylinder.

6. An internal combustion engine in accordance with claim 4 wherein said cylinder assembly also includes a one-piece cylinder block including said crankcase member mounting surface, said cylinder, and a cylinder head mounting surface extending from said cylindrical wall and located in axially spaced relation to said crankcase member mounting surface, and a cylinder head fixed to said cylinder head mounting surface.

7. An internal combustion engine in accordance with claim 4 wherein said cylinder assembly also includes a one-piece cylinder block including said crankcase member mounting surface, said cylinder, and a cylinder head located in axially spaced relation to said crankcase member mounting surface.

8. An internal combustion engine in accordance with claim 4 wherein said valve comprises a reed valve.

9. An internal combustion engine in accordance with claim 4 wherein said inlet passage in said cylinder assembly also includes a carburetor.

10. An internal combustion engine in accordance with claim 4 wherein said inlet passage in said cylinder assembly also includes a throttle valve.

11. An internal combustion engine in accordance with claim 4 wherein said cylinder includes a cylindrical wall, and wherein said cylinder assembly also includes a combustion air inlet port located in said cylindrical wall and opened and closed in response to piston movement in said cylinder, and a transfer passage communicating between said combustion air inlet port and said crankcase.

12. An internal combustion engine in accordance with claim 4 wherein said cylinder assembly also includes a cylinder head mounting surface extending from said cylinder in axially spaced and parallel relation from said crankcase member mounting surface, and a cylinder head fixed to said cylinder head mounting surface.

13. An internal combustion engine in accordance with claim 12 wherein said cylinder head includes an exhaust port, and a combustion air inlet port.

14. An internal combustion engine in accordance with claim 13 wherein said internal combustion engine further includes a conduit extending between said discharge port in said crankcase assembly and said inlet port in said cylinder assembly and including therein a valve permitting flow from said crankcase and preventing flow to said crankcase.

15. An internal combustion engine in accordance with claim 14 wherein said valves comprise reed valves.

16. An internal combustion engine in accordance with claim 14 wherein said conduit is formed in said cylinder assembly.

17. A two-stroke internal combustion engine comprising a crankcase assembly including a crankcase member including a crankcase cover mounting surface, and a cylinder assembly mounting surface including therein an opening, an inlet port, and a discharge port, an inlet passage communicating with said inlet port, a discharge passage communicating with said discharge port, a crankcase cover fixed to said crankcase member to define therebetween a crankcase communicating with said opening in said cylinder mounting surface and with said inlet passage and said discharge passage in said crankcase member, needle roller bearings supported by said crankcase, a crankshaft supported by said roller bearings, extending in said crankcase, and including a crankpin, and a connecting rod rotatably mounted on said crankpin and extending through said opening in said cylinder assembly mounting surface, a cylinder assembly including a crankcase mounting surface fixed to said cylinder assembly mounting surface of said crankcase assembly, a cylinder extending from said crankcase assembly mounting surface, communicating with said opening in said cylinder assembly mounting surface of said crankcase assembly, and including a cylindrical wall, a piston located in and being axially moveable in said cylinder, and connected to said connecting rod.

18. A four-stroke internal combustion engine comprising a crankcase assembly including a crankcase member including a crankcase cover mounting surface, and a cylinder assembly mounting surface including therein an opening, an inlet port, and a discharge port, an inlet passage communicating with said inlet port, a discharge passage communicating with said discharge port,a crankcase cover fixed to said crankcase member to define therebetween a crankcase communicating with said opening in said cylinder mounting surface, needle roller bearings supported by said crankcase, a crankshaft supported by said roller bearings, extending in said crankcase, and including a crankpin, and a connecting rod rotatably mounted on said crankpin and extending through said opening in said cylinder assembly mounting surface, a cylinder assembly including a crankcase mounting surface fixed to said cylinder assembly mounting surface of said crankcase assembly, a cylinder extending from said crankcase assembly mounting surface and communicating with said opening in said cylinder assembly mounting surface of said crankcase assembly, and a cylinder head mounting surface extending from said cylinder in axially spaced and parallel relation from said crankcase assembly mounting surface, and a cylinder head fixed to said cylinder head mounting surface and including an exhaust port, and an inlet port, and a piston located in and being axially moveable in said cylinder, and connected to said connecting rod.

19. An internal combustion engine in accordance with claim 18 wherein said cylinder assembly also includes an inlet passage extending from said crankcase assembly mounting surface, communicating with said opening in said crankcase assembly mounting surface, and including therein a valve permitting flow into said crankcase and preventing flow from said crankcase, and wherein said internal combustion engine further includes a conduit extending between said crankcase and said inlet port and including therein a valve permitting flow from said crankcase and preventing flow to said crankcase.

20. An internal combustion engine in accordance with claim 19 wherein said conduit is formed in said cylinder assembly and communicates with said opening in said cylinder assembly mounting surface of said crankcase assembly.

* * * * *